US005875903A

United States Patent [19]

Chen

[11] Patent Number: 5,875,903

[45] Date of Patent: Mar. 2, 1999

[54] BATHROOM HANGER RACK

[76] Inventor: Wen-San Chen, 56, Minsheng Street, Fengyuan, Taichung Hsien, Taiwan, 420

[21] Appl. No.: 4,618

[22] Filed: Jan. 8, 1998

[51] Int. Cl.[6] ..... A47F 5/00

[52] U.S. Cl. ..... 211/105.1; 211/123; 248/201

[58] Field of Search ..... 248/201, 220.21, 248/221.11, 251, 261, 558; 211/105.1, 123

[56] References Cited

U.S. PATENT DOCUMENTS

| | | | |
|---|---|---|---|
| D. 139,145 | 10/1944 | Sadowski | 211/105.1 X |
| 1,759,319 | 5/1930 | Monroe | 248/251 X |
| 2,490,854 | 12/1949 | Bozoti | 248/251 X |
| 2,542,941 | 2/1951 | Post | 248/251 X |
| 2,590,410 | 6/1952 | Hurley | 211/123 X |
| 3,098,240 | 7/1963 | Fleenor | 248/251 |
| 4,915,343 | 4/1990 | Terlecke | 248/251 |
| 4,979,713 | 12/1990 | Bell | 248/221.11 |
| 5,678,703 | 10/1997 | Sawyer | 211/105.1 |

*Primary Examiner*—Daniel P. Stodola
*Assistant Examiner*—Vestan Bo Booth

[57] ABSTRACT

A bathroom hanger rack has two base seats, two hollow casings, two bolts, two hollow balls, two caps, and a rod. Each hollow ball has a threaded hole, a groove, a middle interior, and a lower interior. Each base seat has a middle portion and two lateral portions. Each middle portion has an oblong hole. Each lateral portion has a round hole receiving a screw. A hollow post is disposed on the middle portion of the base seat. Each hollow ball is disposed on each respective hollow casing. A bottom of each hollow post is enclosed by a ring. Each groove receives the rod. A bolt passes through the respective threaded hole and is inserted in the hollow post. Each hollow casing has an interior receiving the respective base seat. Each threaded hole receives the respective cap.

1 Claim, 5 Drawing Sheets

BATHROOM HANGER RACK

BACKGROUND OF THE INVENTION

This invention relates to a hanger rack, and more particularly to a hanger rack installed in a bathroom.

Referring to FIGS. 1 and 2, a traditional hanger rack 1 has two base seats 3, two hollow truncated-cone casings 4, two rings 5, two support balls 6, and a rod 7. Each support ball 6 has a groove 603 and a threaded hole 602. Each hollow truncated-cone casing 4 has a through hole 401. Each base seat 3 has a solid post 301 which passes through the through hole 401, the ring 5, and a lower portion of the support ball 6. The groove 603 receives the rod 7. A plurality of screws 2 fasten the base seats 3 on a wall. A plurality of perforated holes should be drilled on the wall. However, the perforated holes may not match the screws 2. Furthermore, the distance between two base seats 3 may not match the length of the rod 7.

SUMMARY OF THE INVENTION

An object of this invention is to provide a bathroom hanger rack which can adjust the distance between two base seats.

DETAILED DESCRIPTION OF THE INVENTION

Figure 1:
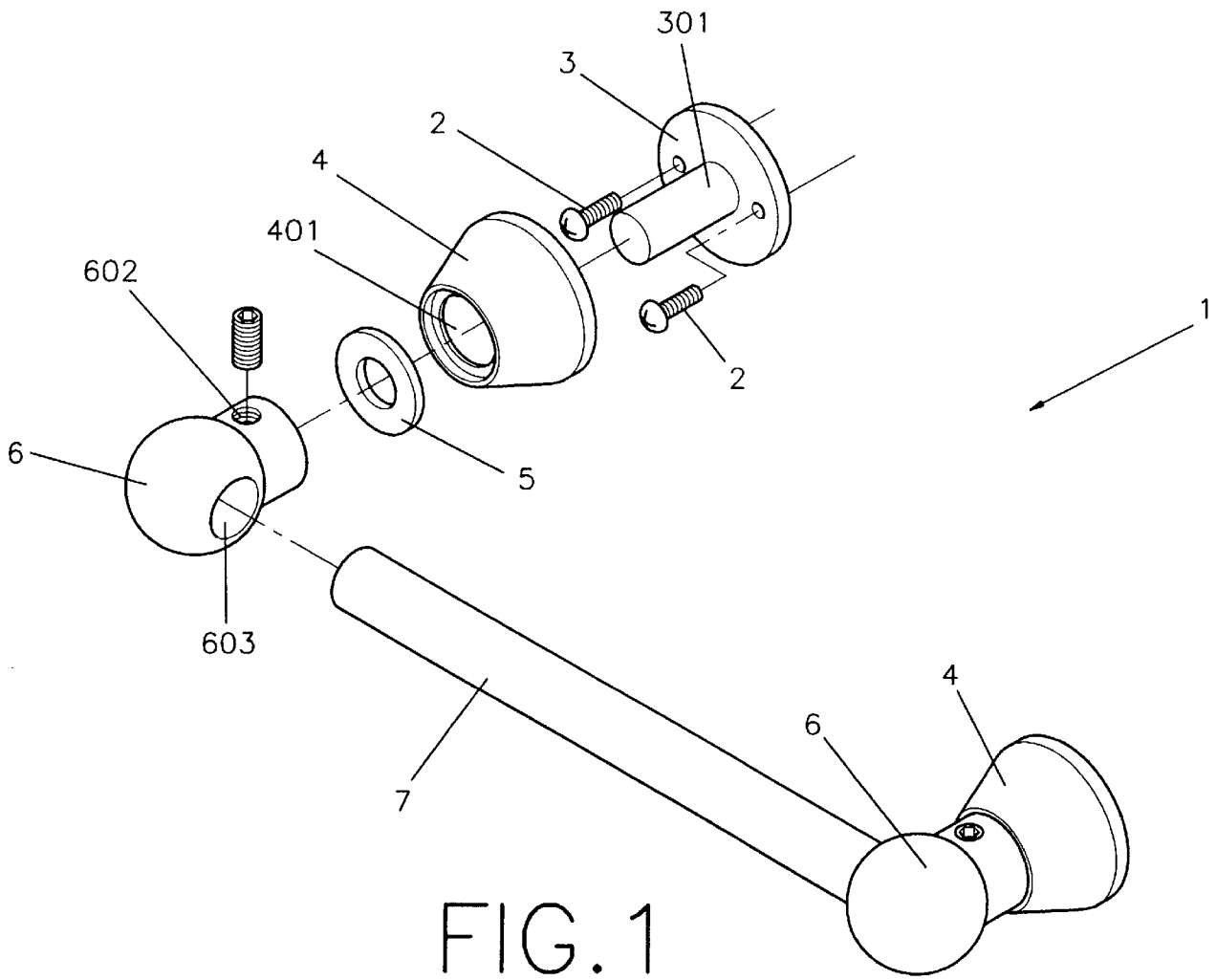
FIG. 1 Prior Art
FIG. 1 is a perspective exploded view of a hanger rack of the prior art.
Figure 2:
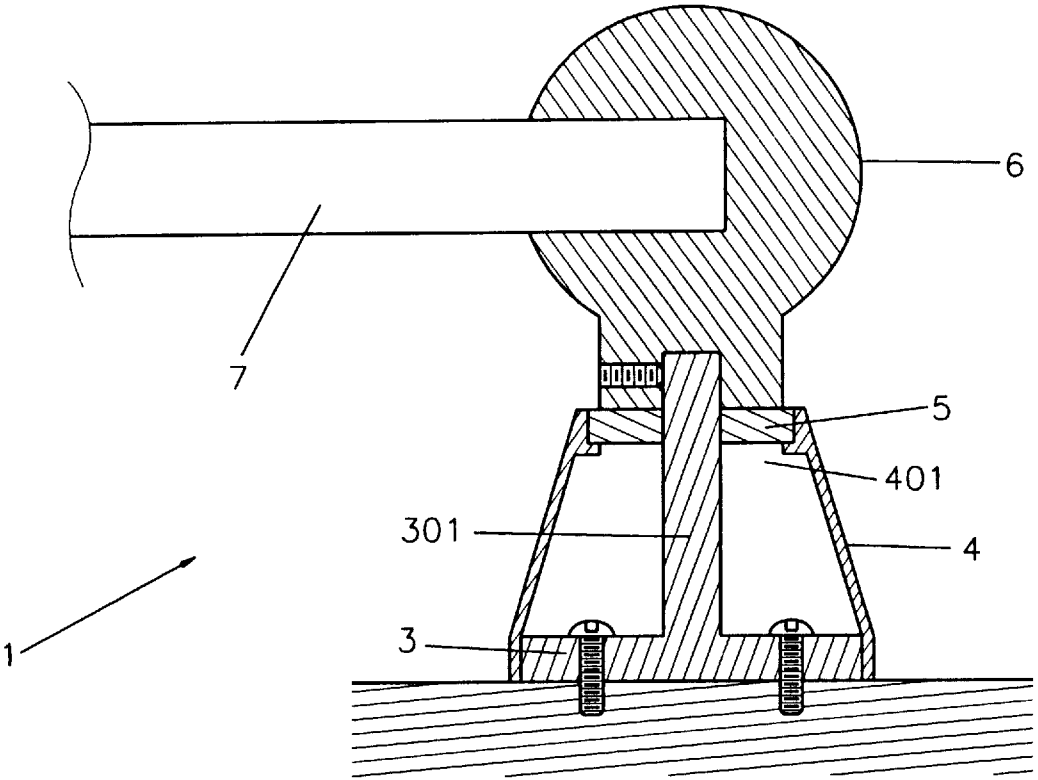
FIG. 2 Prior Art
FIG. 2 is a partially sectional assembly view of a hanger rack of the prior art.
Figure 3:
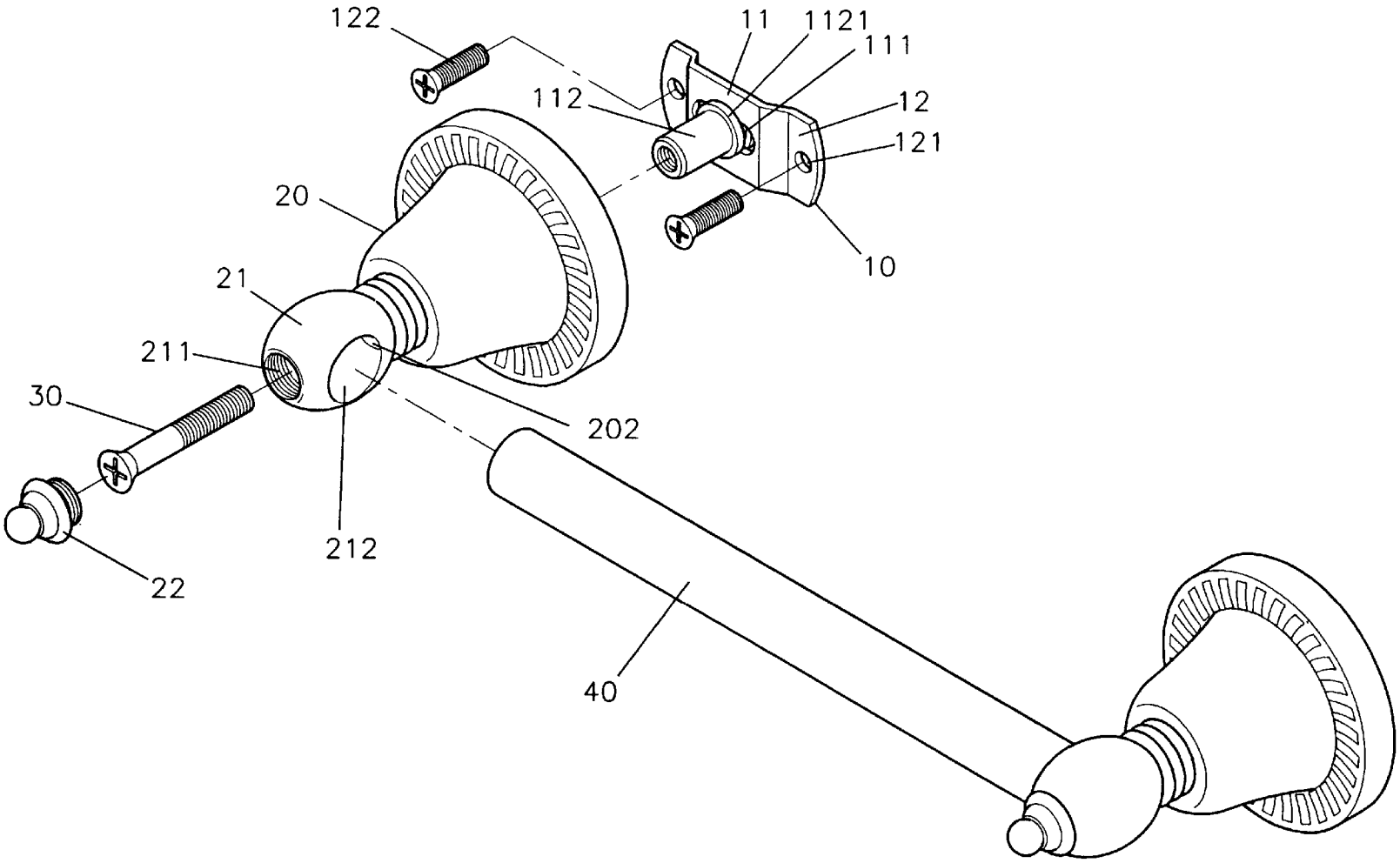
FIG. 3 is a perspective exploded view of a bathroom hanger rack of a preferred embodiment in accordance with this invention.
Figure 4:
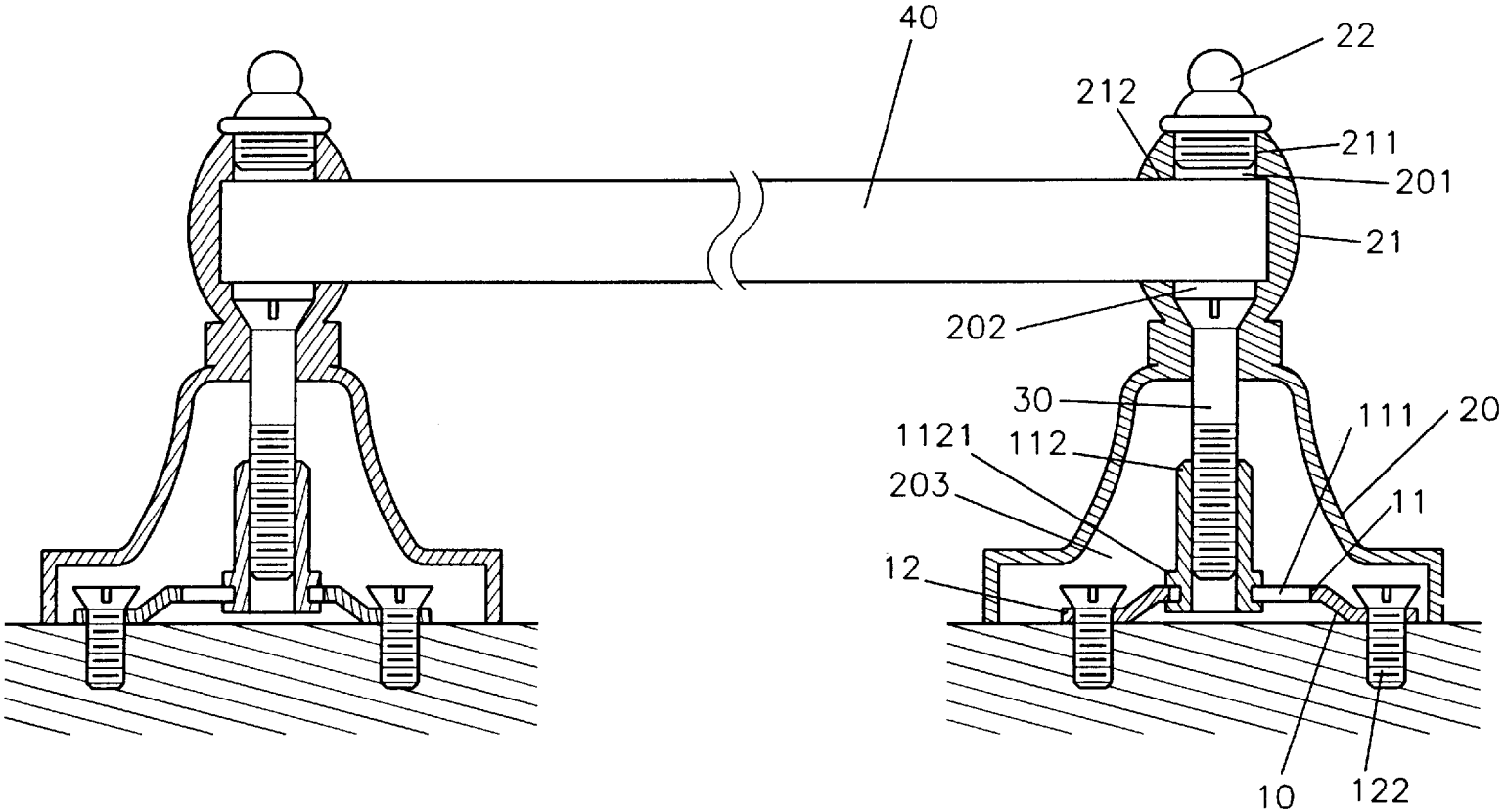
FIG. 4 is a sectional assembly view of a bathroom hanger rack of a preferred embodiment in accordance with this invention.
Figure 5:
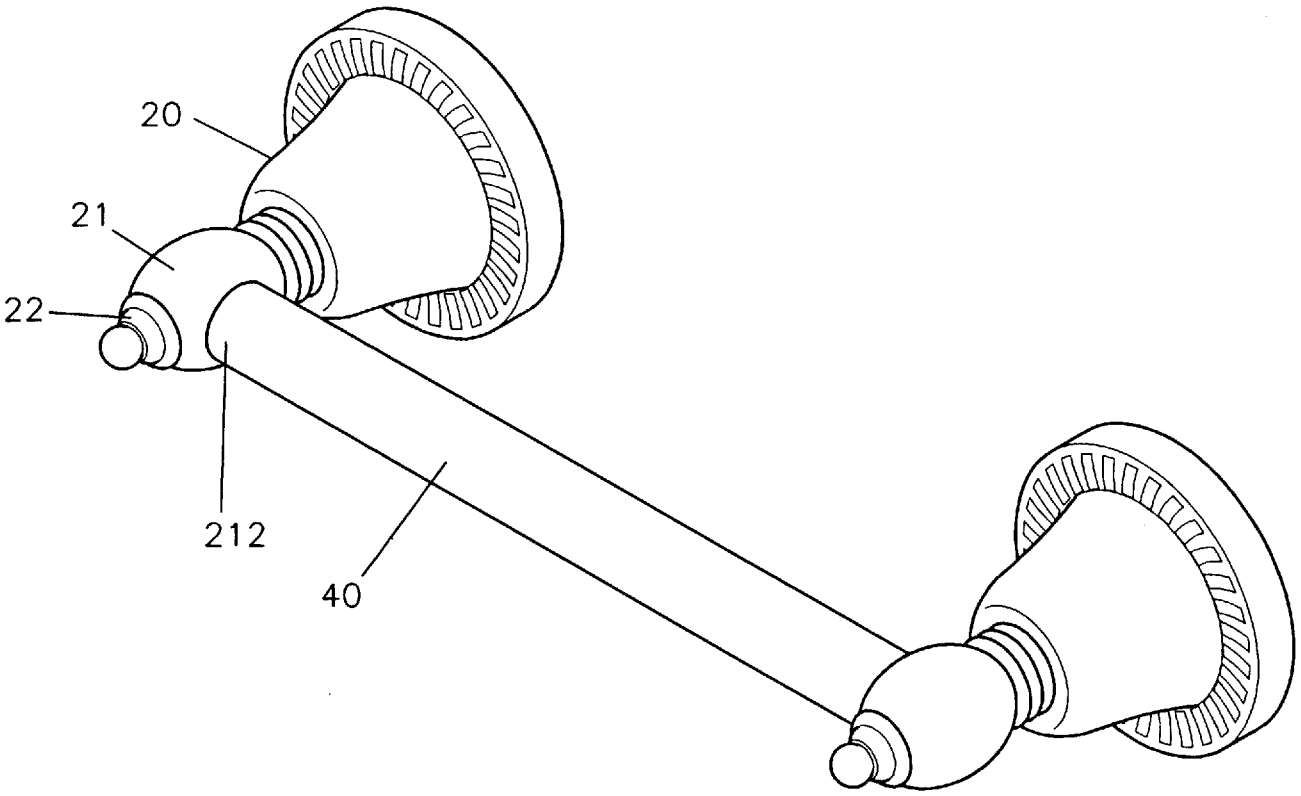
FIG. 5 is a perspective assembly view of a bathroom hanger rack of a preferred embodiment in accordance with this invention.

Referring to FIGS. 3 to 5, a bathroom hanger rack comprises two base seats 10, two hollow casings 20, two bolts 30, two hollow balls 21, two caps 22, and a rod 40. Each hollow ball 21 has a threaded hole 211, a groove 212, a middle interior 201 communicating with the threaded hole 211, and a lower interior 202 communicating with the middle interior 201. Each base seat 10 has a middle portion 11 and two lateral portions 12. Each middle portion 11 has an oblong hole 111. Each lateral portion 12 has a round hole 121 receiving a screw 122. A hollow post 112 is disposed on the middle portion 11 of the base seat 10. Each hollow ball 21 is disposed on each respective hollow casing 20. A bottom of each hollow post 112 is enclosed by a ring 1121. Each groove 212 receives the rod 40. A bolt 30 passes through the respective threaded hole 211 and is inserted in the hollow post 112. Each hollow casing 20 has an interior 203 receiving the respective base seat 10. Each threaded hole 211 receives the respective cap 22.

The user can drill a plurality of perforated holes on the wall of the bathroom. The screw 122 is inserted in the respective round hole 121 and the respective perforated hole. A lower end of each hollow post 112 is inserted in the respective oblong hole 111. The hollow post 112 can be moved along the oblong hole 111 before the bolt 30 is inserted in the hollow post 112. Therefore, the distance between two base seats 10 can be adjusted. After the bolt 30 is inserted in the respective hollow post 112, the cap 22 is inserted in the respective threaded hole 211.

I claim:

1. A bathroom hanger rack comprises:

two base seats, two hollow casings, two bolts, two hollow balls, two caps, and a rod, each said hollow ball having a threaded hole, a radially extending groove, a middle interior communicating with the threaded hole, and a lower interior communicating with the middle interior, each said base seat having a middle portion and two lateral portions, each said middle portion having an oblong hole, each said lateral portion having a round hole receiving a screw, a respective hollow post having an integral ring at the bottom thereof within each said oblong hole, said ring retaining said hollow post in said oblong hole each said hollow casing having an interior communicating with the lower interior and receiving the respective base seat, a bolt passing through the respective threaded hole and inserted into the respective hollow post, and each said groove receiving a respective end of said rod, and each threaded hole receiving the respective cap.

* * * * *